US007854033B1

(12) United States Patent
Kinder

(10) Patent No.: US 7,854,033 B1
(45) Date of Patent: Dec. 21, 2010

(54) APPARATUS AND METHOD FOR CLEANING A MOP

(76) Inventor: Jack G. Kinder, 1209 Fieldcrest Ave., Centralia, WA (US) 98531

( * ) Notice: Subject to any disclaimer, the term of this patent is extended or adjusted under 35 U.S.C. 154(b) by 382 days.

(21) Appl. No.: 12/004,811

(22) Filed: Dec. 21, 2007

(51) Int. Cl.
*B08B 1/00* (2006.01)

(52) U.S. Cl. ..... 15/90; 134/104.2; 134/201

(58) Field of Classification Search ..... 134/104.2, 134/201; 15/90
See application file for complete search history.

(56) References Cited

U.S. PATENT DOCUMENTS

| | | | | |
|---|---|---|---|---|
| 279,572 | A | 6/1883 | Leaycraft | |
| 1,014,027 | A | 1/1912 | Walter | |
| 1,253,939 | A | 1/1918 | Clarke | |
| 1,381,553 | A | 6/1921 | Hilreth et al. | |
| 1,839,582 | A * | 1/1932 | Nordhem | 96/262 |
| 1,914,295 | A | 6/1933 | Riley | |
| 2,197,869 | A | 4/1940 | Kramer | |
| 2,470,601 | A * | 5/1949 | Burke | 451/456 |
| 2,625,704 | A | 1/1953 | Cudy | |
| 2,642,600 | A | 6/1953 | Jones | |
| 2,711,620 | A * | 6/1955 | Shelby | 451/456 |
| 2,849,746 | A | 9/1958 | Hayter | |
| 3,015,121 | A | 1/1962 | Ulrich | |
| 3,411,175 | A | 11/1968 | Mills | |
| 3,412,419 | A * | 11/1968 | Barnhart | 15/257.1 |
| 3,531,818 | A * | 10/1970 | Imm | 15/311 |
| 3,698,213 | A * | 10/1972 | Mann, Jr. | 68/205 R |
| 3,955,528 | A * | 5/1976 | Bounds et al. | 118/678 |
| 7,640,623 | B2 * | 1/2010 | Jung et al. | 15/352 |
| 2002/0170136 | A1 * | 11/2002 | Kinder | 15/311 |

FOREIGN PATENT DOCUMENTS

| | | |
|---|---|---|
| GB | 2 241 145 | * 9/1991 |
| JP | 58-174215 | * 10/1983 |
| JP | 05-192286 | * 8/1993 |
| JP | 08-103620 | * 4/1996 |
| JP | 2001-009229 | * 1/2001 |
| JP | 2003-290108 | * 10/2003 |

* cited by examiner

*Primary Examiner*—Frankie L Stinson
(74) *Attorney, Agent, or Firm*—Brian J. Coyne

(57) ABSTRACT

A mobile machine for removing dry particulate matter from a mop, cloth or duster by agitation. A drum with flexible, resilient fingers rotates and agitates the mop, cloth or duster to loosen the particulate matter. An electric fan sucks ambient air and the particulate matter to a chamber wherein it is wetted by a liquid mist introduced by spray nozzles. The mist combines with the particulate matter to form larger particulates. The particulate matter and larger particulates are passed through a filter to remove the particulate matter and larger particulates, which drop onto a removable tray.

1 Claim, 7 Drawing Sheets

APPARATUS AND METHOD FOR CLEANING A MOP

CROSS-REFERENCE TO RELATED PATENT APPLICATIONS

The applicant filed a patent application on Mar. 30, 2001 in the United States Patent and Trademark Office, which was assigned Ser. No. 09/823,020. That patent application was abandoned.

STATEMENT AS TO RIGHTS TO INVENTIONS MADE UNDER FEDERALLY SPONSORED RESEARCH AND DEVELOPMENT

This invention was developed entirely with private funds and there was no federal assistance.

REFERENCE TO A "MICROFICHE APPENDIX"

This section is not applicable to this patent application.

BACKGROUND OF THE INVENTION

1. Field of the Invention

Brooms, brushes, mops and the like pick up particulate matter such as dust, dirt, lint and hair from a floor. After a while, the brooms, brushes, mops and the like do not effectively pick up the particulate matter. It is necessary to remove the particulate matter from the brooms, brushes, mops and the like. It is desirable to have an apparatus and method for cleaning the brooms, brushes, mops, and the like of the particulate matter. This invention is directed to the removal of the particulate matter from the brooms, brushes, mops, and the like at the place of activity. The apparatus is portable and can be moved from location to location so as to be available for removing particulate matter from brooms, brushes, mops, and the like.

2. Description of the Related Art, Including Information Disclosed Under 37 CFR 1.97 and 37 CFR 1.99

Kramer, U.S. Pat. No. 2,197,869, teaches of a mop cleaning device or deduster for cleaning or removing the dust and dirt from dry mops, dusters, and the like.

Ulrich, U.S. Pat. No. 3,015,121, relates to a vacuum type of cleaner for brooms, brushes, mops, and the like.

Clarke, U.S. Pat. No. 1,253,939, discloses an invention relating to pneumatics and more especially to fluid tanks for removing dust from the air collected on the nozzle of a vacuum cleaner. Clarke is more directly related to a vacuum cleaner than to a device for cleaning a mop or a broom or a duster.

Hildreth, U.S. Pat. No. 1,381,553, is directed to a cleaning machine to provide a simple, inexpensive, and efficient machine for cleaning garments, cloths, pieces of fabric, and the like. Hildreth uses two rotary brushes. One of the brushes is employed to remove dust from the article and the other is to remove sports or stains from the article.

Leaycraft, U.S. Pat. No. 279,572, is directed to a vacuum apparatus that can be used for cleaning rugs, floors, upholstery, and the like. Leaycraft teaches of a pneumatic system that operates by suction, whereby the dirt and dust can be conveniently removed from any place desired, such as floors of stores and buildings, without causing the dust to rise, as is the case where brooms are used, or with the sweepers now ordinarily in use.

Cudy, U.S. Pat. No. 2,625,704, provides a mop cleaner for dry mops and dusters that is clean and sanitary in operation.

This mop cleaner effectively shakes a mop clean, and employs a removable container for receiving dirt, dust and lint shaken from the mop and which also includes means for settling dirt, dust and lint into the removable container.

Jones, U.S. Pat. No. 2,642,600, is directed to providing a readily portable housing with means therein for loosening dirt from a standard floor dust mop in an efficient manner and discharging the dirt from the housing through a suitable outlet.

Hayter, U.S. Pat. No. 2,849,746, provides a cleaning machine having means that will clean a mop, or similar article, with only the necessary amount of fabric agitation or beating and which will also cause an air blast to pass through the fabric concurrently to insure a thorough cleaning job.

Mills, U.S. Pat. No. 3,411,175, provides an improved industrial dust-mop apparatus that comprises an enclosure or console. The enclosure is provided with an adjustable dust mop receiving channel that has a pair of counter-rotating brushes moving downwardly at the bite zone formed between.

Walter, U.S. Pat. No. 1,014,027, is directed to a pneumatic carpet-sweeper and not to an apparatus for cleaning dust cloths and dust mops.

Riley, U.S. Pat. No. 1,914,295, teaches of a dust mop cleaning machine having means for loosening the dust and dirt from the articles being cleaned. Riley describes a novel means for picking up the dust and dirt and carrying it to a place of deposit.

BRIEF SUMMARY OF THE INVENTION

The invention is directed to a portable cleaning apparatus for cleaning a dry mop, cleaning cloth and/or a duster that carries particulate matter, such as dust, dirt, lint and/or hair, to name a few. The dry mop and the cleaning cloth and/or the duster can be cleaned of the particulate matter and used again. In order to remove the particulate matter from the dry mop or the cleaning cloth or the duster, the invention includes a number of resilient, radial fingers that amount to a brush. These radial fingers are rotated and contact the dry mop or the cleaning cloth or the duster to knock loose the particulate matter. The particulate matter is carried by air to the interior of a housing. In the interior of the housing small drops of water are sprayed onto the particulate matter. Then the air and the wet particulate matter are passed through at least one filter so as to remove the wet particulate matter and to allow the moisture and air to escape from the housing. The filter with the wet particulate matter can be discarded or can be cleaned and used again.

BRIEF DESCRIPTION OF THE SEVERAL VIEWS OF THE DRAWINGS

In the drawings, it is seen that.

Similar numerals designate similar component parts of the invention throughout the several views.

DETAILED DESCRIPTION OF THE INVENTION

Figure 1:
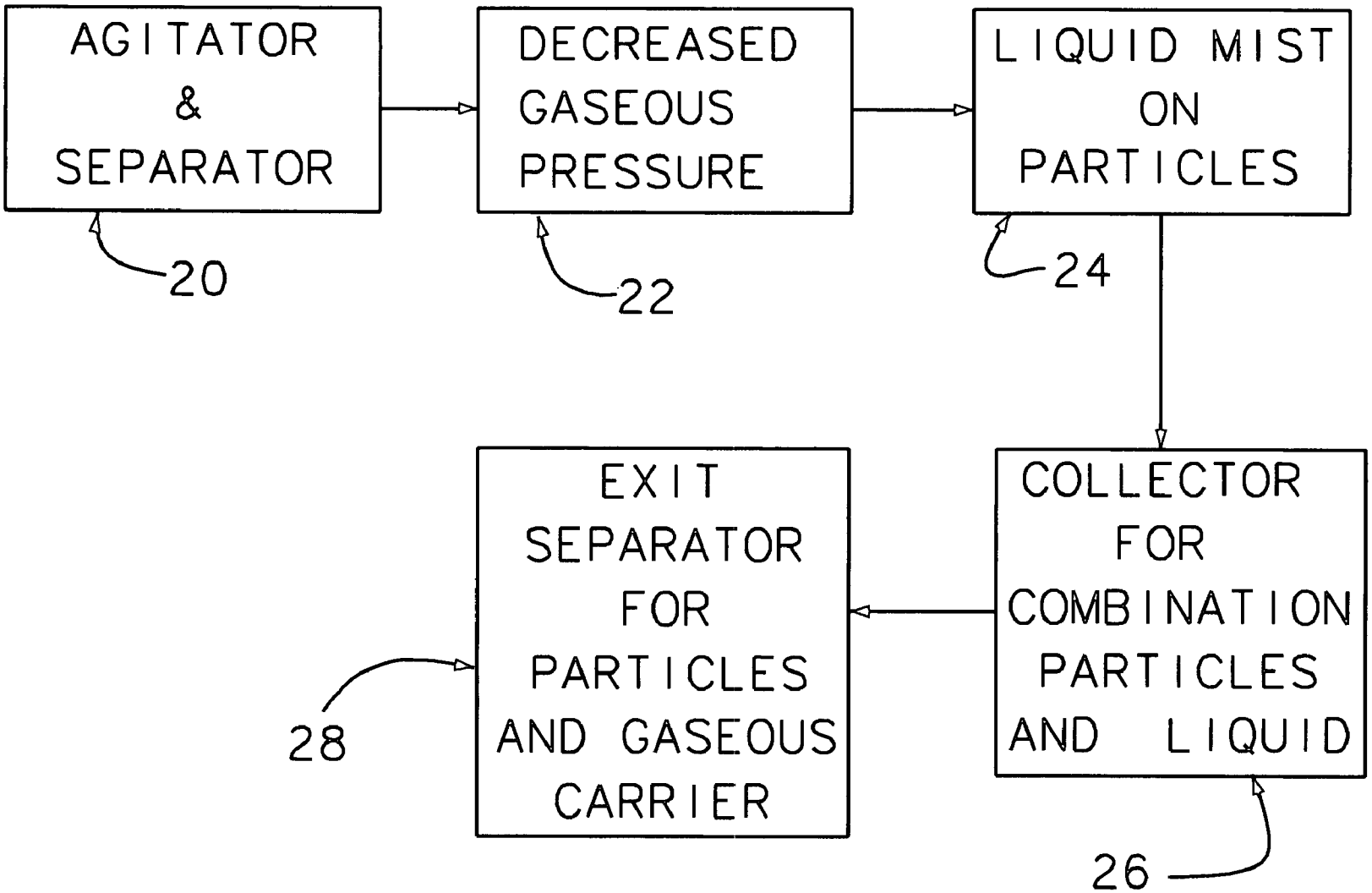
FIG. 1 is a block diagram of the method for separating particulate matter from a dust mop or cleaning cloth or duster.

In FIG. 1 there is illustrated, in a block diagram, the method steps involved for cleaning particulate matter from a dry mop or a cleaning cloth. Reference numeral 20 refers to an agitator and separator for removing particulate matter such as dust, dirt, line and hair from a dry mop, cleaning cloth or a duster. With the particulate matter removed, the particulate matter is moved by the flow of air under the decreased air pressure 22. The particulate matter in the flow of air is introduced to a liquid mist or fine spray of liquid. Liquid mist or fine spray settles on the particles in step 24. Then the combination of the liquid mist and particulate matter flows to a collector for the combination of these particles and liquid at step 26. The combination of the mist and the particulate matter of step 26 flow to an exit separator such as a filter for removing the combination of the particulate matter and the mist and also for removing the particulate matter at step 28. Again, a filter may be used for removing the particulate matter at step 28 so as to produce clean air at the exit of the apparatus.

In summary, the invention includes an agitator and separator for separating the particulate matter from the dry mop or cleaning cloth. Due to the decreased air pressure, the particulate matter flows from the agitator and separator and into the apparatus. A liquid mist is applied at 24 to the particulate matter. The combination of the particulate matter and the liquid mist goes to a collector. Then the combination of the air and particulate matter and mist pass through a filter so as to remove the particulate matter such as dust, dirt, hair and lint. The air and the mist can flow through the filter and out into the atmosphere.

A frame 30 comprises two laterally spaced-apart, lower longitudinal beams 32 and two longitudinally spaced-apart, lower lateral beams 34 that connect opposite first and second ends of the two lower longitudinal beams. This provides support for the components of the apparatus. Attached to each of the four junctions of the lower longitudinal beams 32 with the lower lateral beams 34 is an upright support 36—so that there are four upright supports 36 in all. Two laterally spaced-apart upright members 70 are disposed intermediate the upright supports 36 and have lower ends attached to the lower longitudinal beams 32. A support shelf 72 connects with the two upright members 70 and also with the upright members 36.

Figure 2:
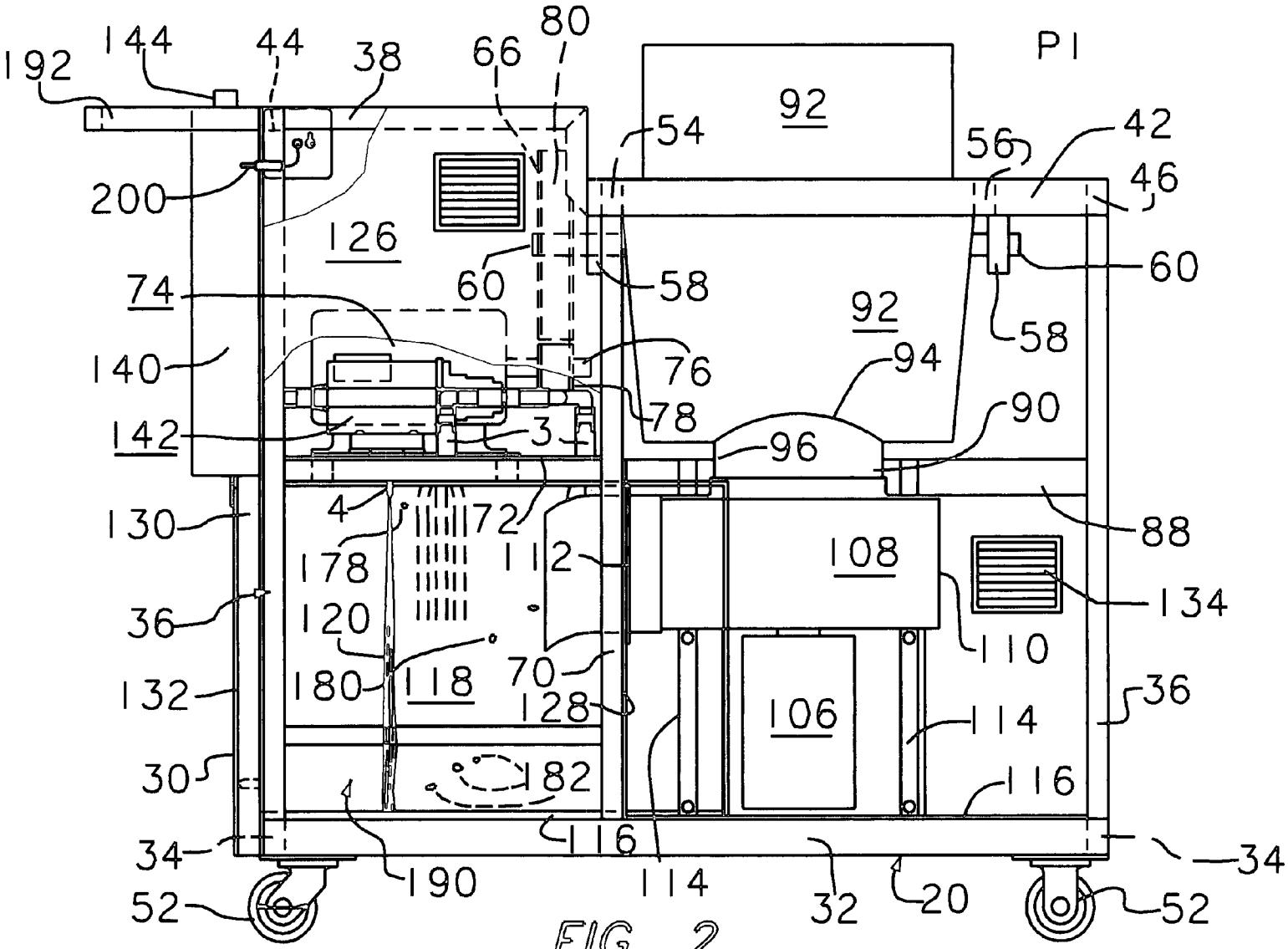
FIG. 2 is a first side elevational view of the apparatus for removing the particulate matter from the dry mop of the cleaning cloth or duster.
Figure 4:
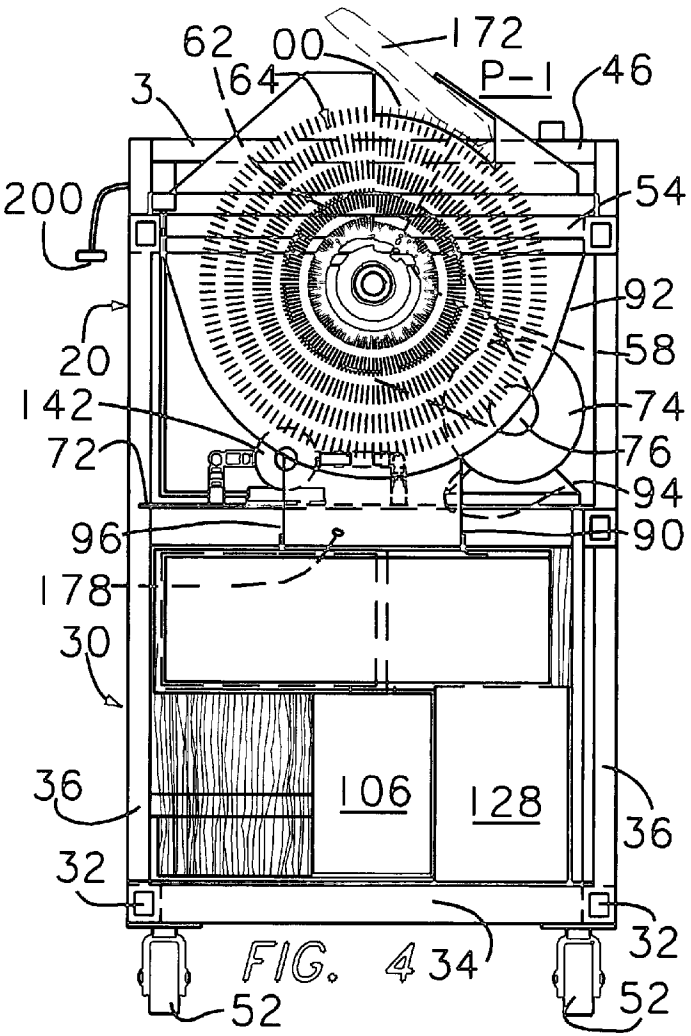
FIG. 4 is a second, opposite end elevational view of said apparatus.
Figure 3:
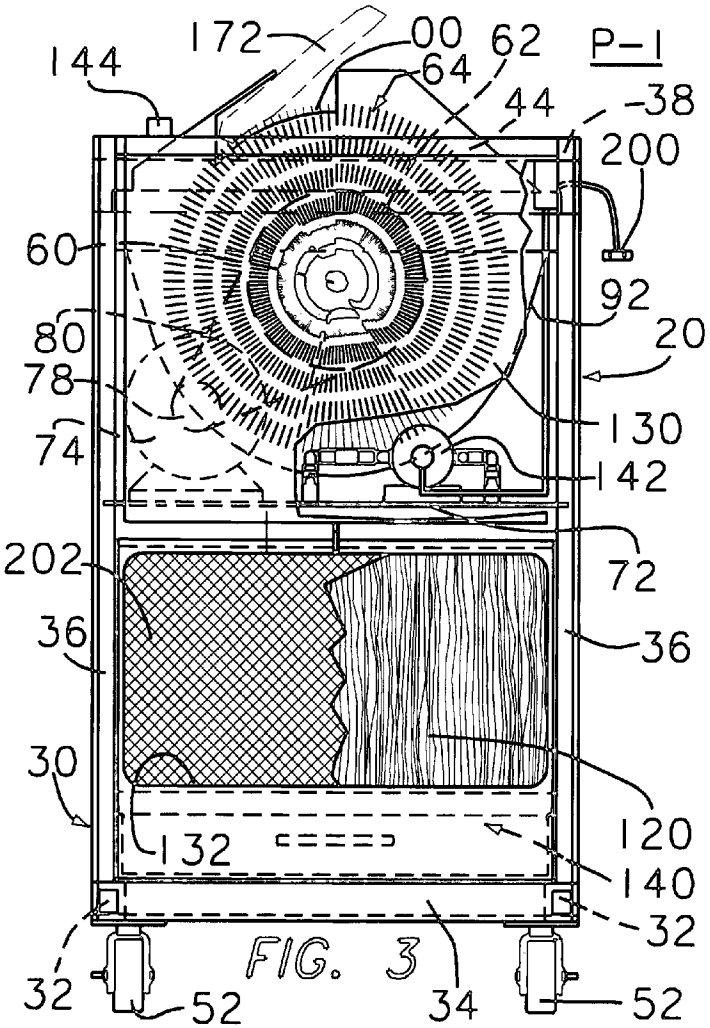
FIG. 3 is a first end elevational view of said apparatus.
Figure 5:
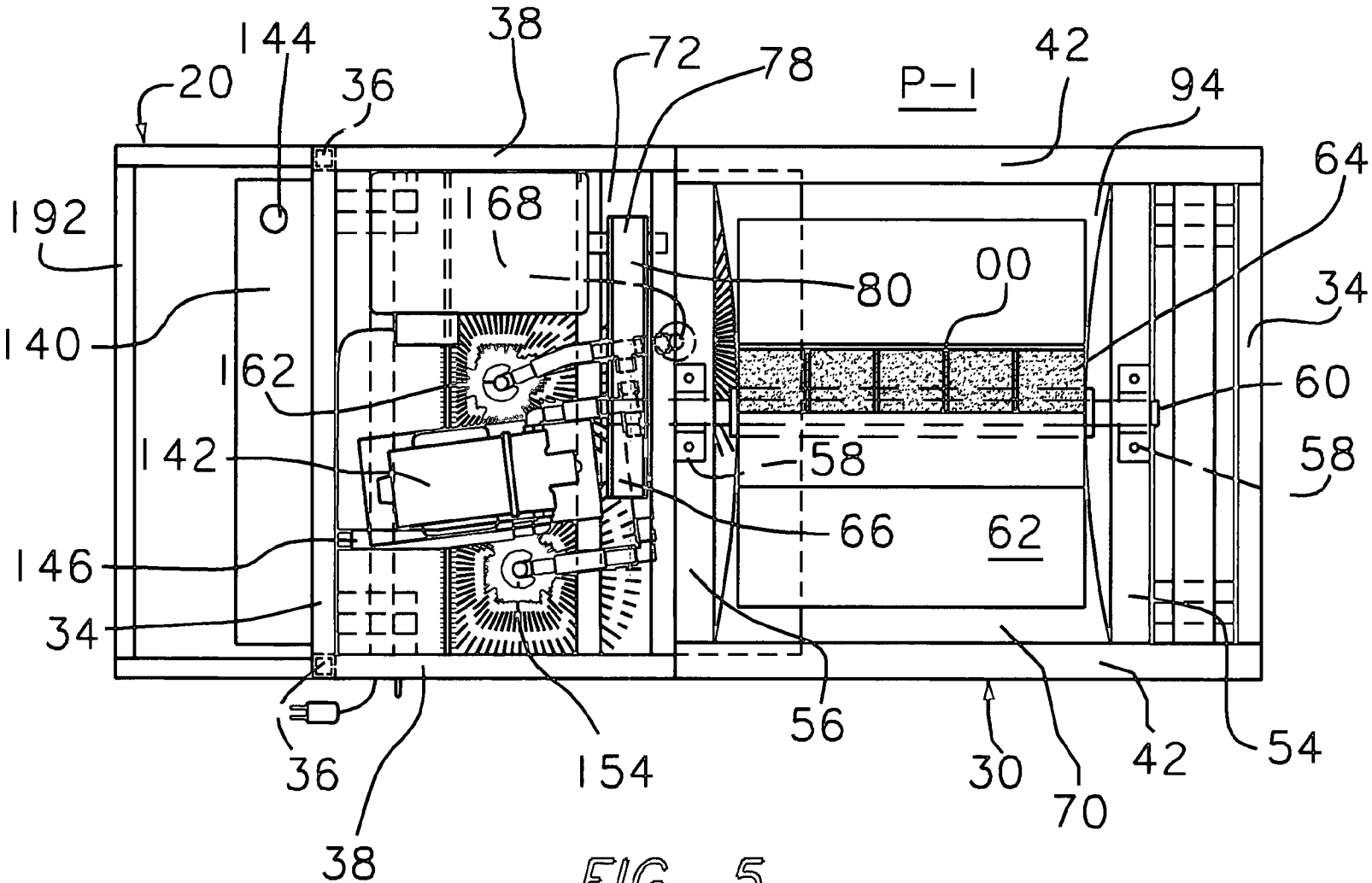
FIG. 5 is a top plan view of said apparatus.
Figure 6:
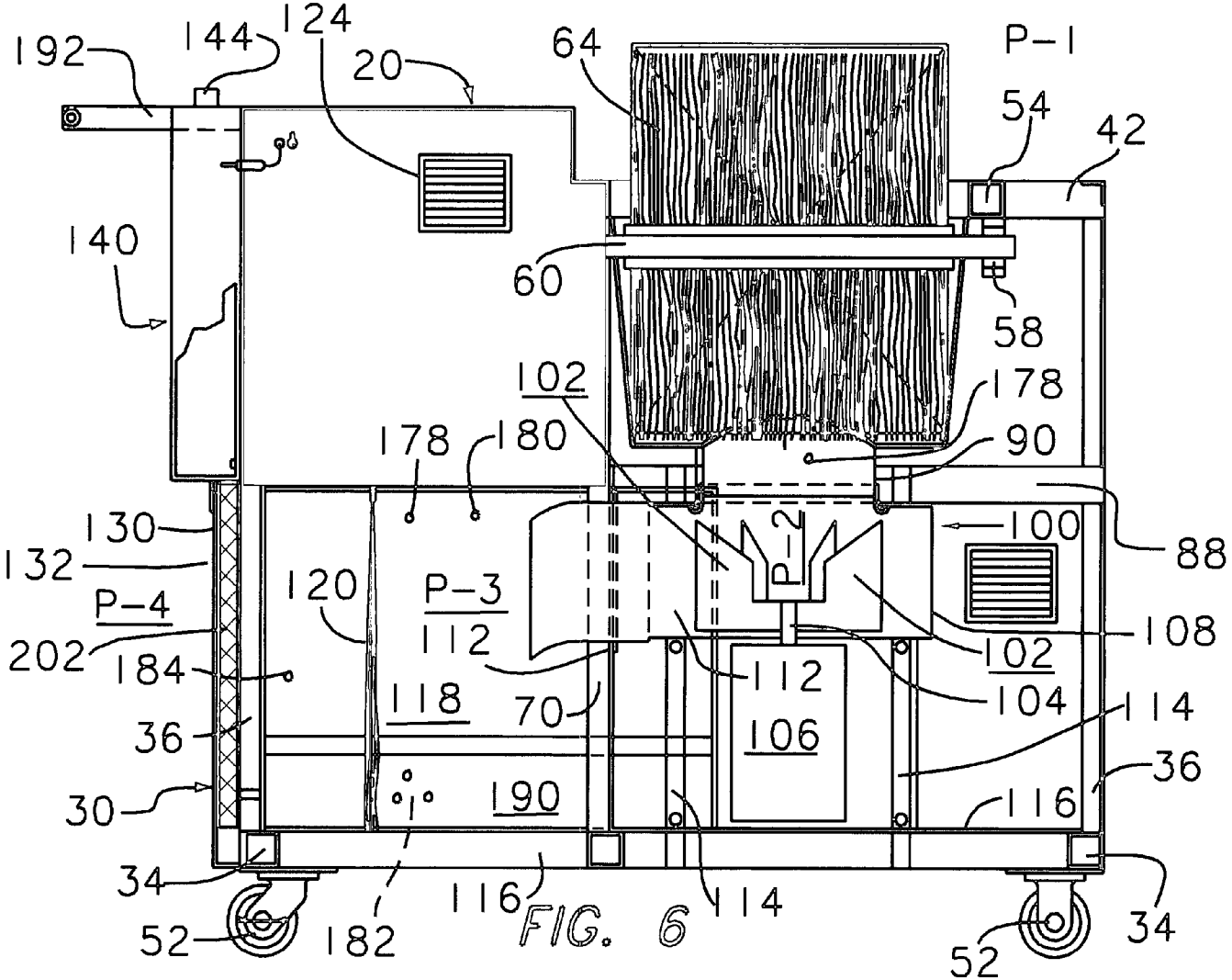
FIG. 6 is a first side elevational view of said apparatus illustrating some of the components of said apparatus.
Figure 8:
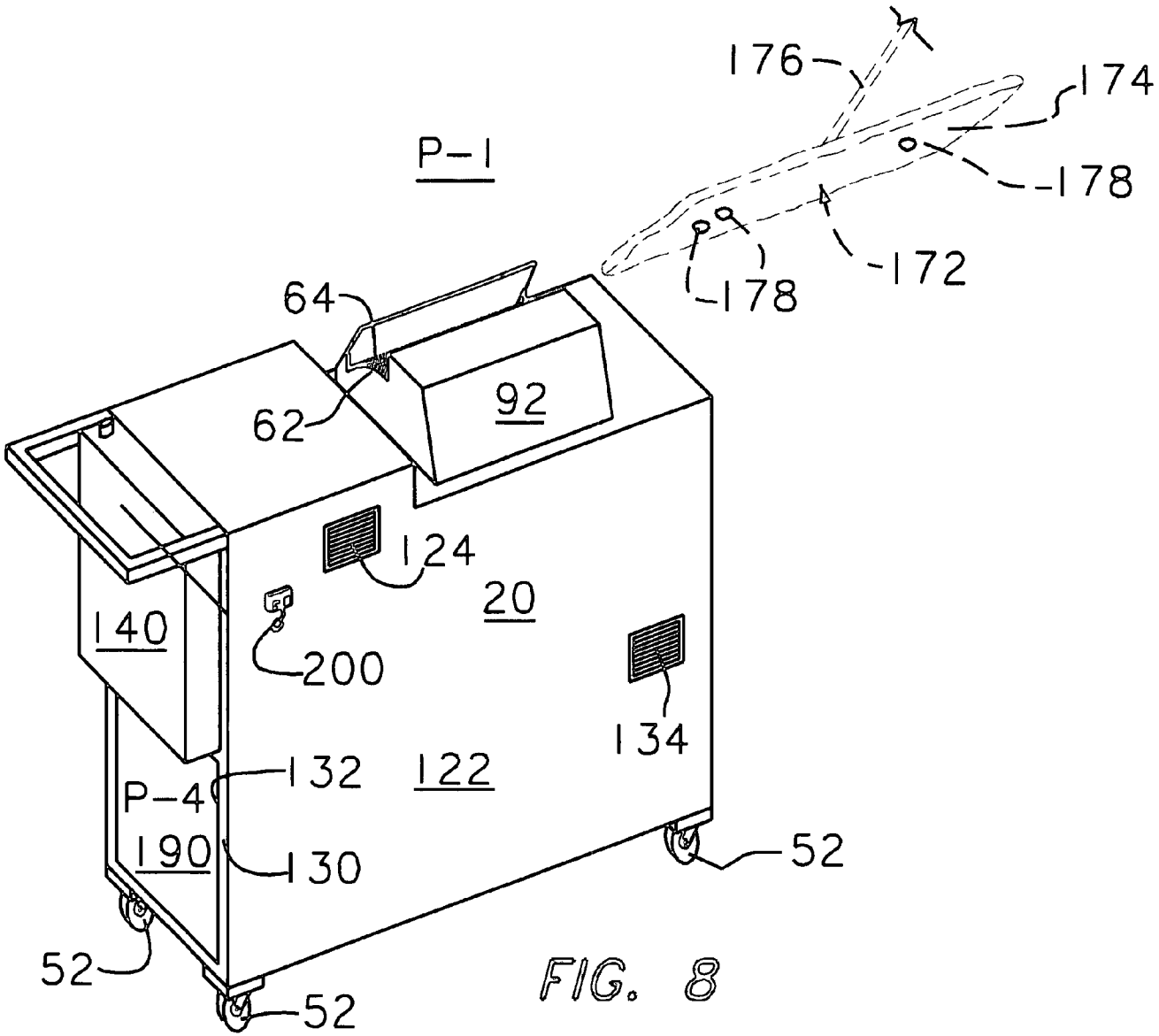
FIG. 8 is a perspective view of the apparatus awaiting the introduction of a mop (depicted in phantom outline).

In FIG. 2, it is seen that, on each of the opposite sides of the apparatus, there are laterally spaced-apart upper beams 38, 42 that connect upper ends of the upright supports 36 to upper ends of the upright members 70. Near the first end of the apparatus, a first lateral upper beam 44 has opposite ends attached to upper ends of the adjacent upright supports 36. At the second end of the apparatus, a second lateral upper beam 46 has opposite ends attached to upper ends of the adjacent upright supports 36. This provides rigidity and strength to the frame 30. At the four corners of the frame 30, and underneath the frame, are four spaced-apart, caster wheels 52 to facilitate wheeled motion of the apparatus from location to location. As may be seen in FIG. 5, longitudinally spaced-apart, lateral supports 54, 56 have opposite ends attached to the upper beams 42. On the lateral support 54 there is a bearing 58, and on the lateral support 56 there is another bearing 58. The two bearings 58 are aligned for receiving a drum shaft 60. Mounted on the shaft 60 is a drum 62. On the exterior of the drum 62 there are a plurality of flexible, resilient bristles 64. An electric motor 74 is mounted on the support shelf 72. The electric motor has an output shaft 76 upon which is mounted a pulley 78. A belt 80 runs around the pulley 78 and also around a pulley 66 mounted to the shaft 60 for rotating the drum 62. A drum housing 92 substantially surrounds the drum 62 to confine the particulate matter to the interior of the apparatus, but has an access opening at the top to permit a dry mop, cleaning cloth and the like to contact the fibers 64. The electric motor 74 by means of the pulley 66 and the drive belt 80, causes the drum 62 with its flexible, resilient fibers 64 to rotate and to dislodge the particulate matter from any dry mop, cleaning cloth, and the like that is placed adjacent to the rotating fibers 64. In the bottom of the drum housing 92 is an outlet passageway 94 to allow the particulate matter to move down through a top opening of a shroud 108 that is disposed below the passageway 94. Within the shroud 108 and below the outlet passageway 94 is an electric fan 100 that has fan blades 102 mounted to an upstanding fan blade shaft 104 for rotation about a vertical axis. The shroud 108 also has an open passageway 112 that faces toward the first end of the apparatus and through which it discharges air and particulates into a substantially closed chamber 118 to which it is attached and by which it is supported; see FIG. 6. The chamber 118 has a floor 116 supported on beams 32 and 34. Exiting gas from the apparatus containing particulate matter passes through a filter 120 that is mounted within the chamber 118, thereby removing the particulate matter from the gas. The exit gas is mainly air and some fine water mist. In FIG. 8, it is seen that there is a first side panel 122; an upper portion of this panel has an air vent 124 that communicates with a fan compartment 106 that houses the fan motor below the shroud 108 to cool the fan motor. On the opposite side of the apparatus there is a second side panel 126 and a first end panel 130 covers the first end of the apparatus; see FIG. 2. In the first end panel 130 there is an exit opening 132 to allow air to escape from the apparatus. From the foregoing it is seen that a chamber 118 is defined by side panel 126, floor 116, end panel 128, side panel 122, exit end panel 130, first end panel 132, and support shelf 72.

Figure 7:
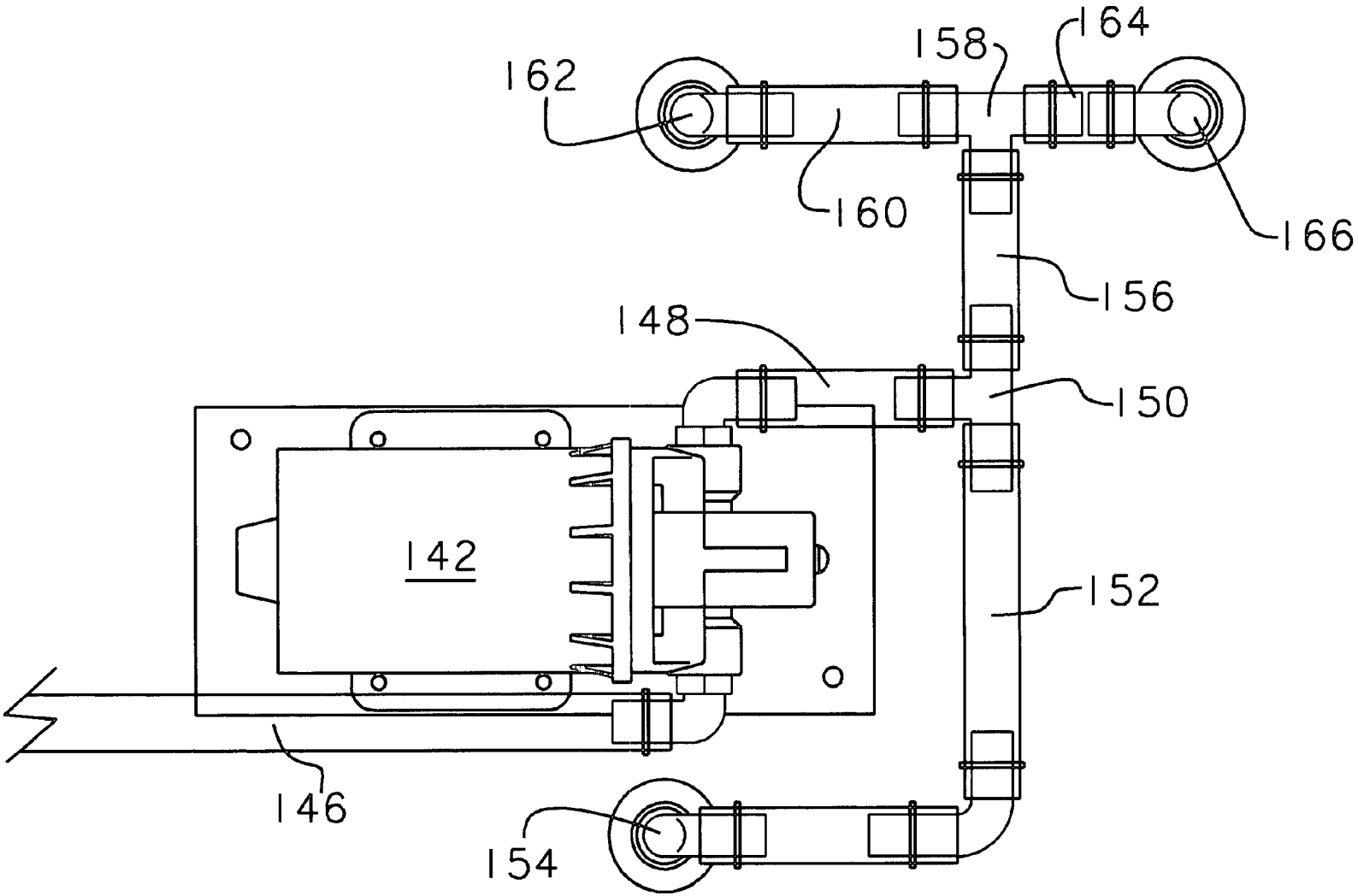
FIG. 7 is a top plan view of the spray nozzle arrangement of said apparatus.

A removable water tank 140 with a filler cap 144 rests in a cradle disposed at the first end of the apparatus and has a liquid outlet. Referring to FIGS. 2 and 7, a water line 146 conducts water from the liquid outlet of the tank 140 to a water pump 142 that is mounted to the top of the chamber 118 near the first end of the apparatus. A water pipe 148 has a first end connected to the outlet of the water pump 142 and an opposite, second end connected to a tee-pipe 150. A water pipe 152 is connected to a first outlet of the tee 150 and also with a first spray nozzle 154. Further, a second outlet of the tee 150 is connected to a water pipe 156 that in turn connects to a tee 159. A water line 160 is connected to a first outlet of the tee 158 and also with a second spray nozzle 162. Further, the tee 158 is connected to a water pipe 164 that in turn is connected to a third spray nozzle 166.

The three spray nozzles 154, 162, and 166 are in the chamber 118. These spray nozzles are so positioned that they can spray a fine mist of water 180 or other liquid on the particulate matter 178 being moved by the air from the fan 100 and the fan blades 102. The fine mist of water 180 adheres to the particulate matter 178 so as to form a combination 182 of particulate matter and water of a size larger than the particulate matter 178 by itself. This makes it possible to more completely remove the particulate matter from the flow of air. The particulate matter 178 becomes heavy and settles to the bottom of a removable tray 190 that is housed within a lower portion of the chamber 118. An electrical plug inlet 200 is mounted to the first side panel 122 and is wired to the electric motor 74, water pump 142 and electric fan motor 106.

FIG. 8 is a schematic illustration of a dry mop 172 being introduced to the apparatus and to the flexible, resilient fibers 64 of the drum 62. The symbolic mop 172 denotes a dry mop, a cloth or a duster. The mop 172 or the like can be introduced to the top access opening of the housing 92 of the apparatus and the flexible, resilient fibers 64 on the drum 62 will agitate the mop or cloth or duster so as to separate particulate matter from the cloth or mop or duster. Outside of the drum 62 and also outside of the apparatus 20 the air is at ambient atmospheric pressure P-1. The electric motor 106 rotates the fan blade shaft 104 and the fan blades 102. The air pressure P-2 at the fan blades 102 is less than the ambient atmospheric pressure P-1—that is, there is a differential air pressure between P-1 and P-2. As a result, the atmospheric pressure P-1 forces the particulate matter 178 toward the fan blades 102. Then the fan blades force the air and particulate matter through the open passageway 112 and into the chamber 118. The air pressure of P-3 in the chamber 118 is greater than the air pressure P-2 of the fan blades. However, the fan blades 102 force the air into the chamber 118 so as to increase the air pressure to that of P-3. There is a filter means 120. The pressure P-4 outside of the apparatus 20 is atmospheric pressure or substantially atmospheric pressure. The pressure P-1 and P-4 are substantially the same as they are substantially atmospheric pressure. Since the gaseous pressure P-3 is greater than the gaseous pressure P-4 the flow of particulate matter 178 and of the combination 182 with gas is to the filter 120; that is there is a differential air pressure between P-3 and P-4. Most of the particulate matter 178 is removed by the spray nozzles 154, 162, and 166 to form the combination 182. To ensure greater removal of the particulate matter there is a mist or spray from the spray nozzle 154, 162, and 166. The fine spray of water 180 lands on the particulate matter 178 making the combination 182 heavier and making it possible to more completely remove particulate matter. An exit filter 202, which may be a solid filter, removes the smallest particulate matter 182.

In use, the apparatus is switched on and the mop 172 with particulate matter 178 attached is introduced to the rotating drum 62 through the access opening at the top of the housing 92. The flexible, resilient fibers 64 on the rotating drum 62 agitate the mop 172 and the particulate matter 178 so as to dislodge the particulate matter from the mop 172. The descending air from the drum 62 carries the particulate matter 178 through the shroud 108 to the chamber 118. In the chamber 118 a fine mist of water 180 is introduced and combines with some of the particulate matter 178 to form a combination 182 of the particulate matter 178 and the water 180. To repeat, the pressure P-3 is greater than the pressure P-4, which is ambient atmospheric pressure. The combination of the particulate matter 178 and water mist 180 is directed to the filter 120. The particulate matter 178 does not pass through the filter 120. The combination 182 of the mist and particulate matter 178 is filtered out the air stream by the filter 120. The air and water mist 180 pass through the filter 120. When the filter 120 is saturated or near saturated with particulate matter 178 the filter 120 can be removed and cleaned or discarded. In this manner the particulate matter 178 can be collected in one area or one place so as not to be distributed over a wide area. In particular, at the bottom of the chamber 118 there is a water tray that collects particulate matter 178, water mist 180 and the combination 182 of the particulate matter and the water mist. The material collected by the tray or container 190 can be discarded. The exit filter 202 may also be discarded and replaced after being used.

From the foregoing description it will be clear that the present invention may be embodied in other specific forms without departing from the spirit or essential characteristics thereof. Thus, the presently disclosed embodiment is to be considered in all respects as illustrative and not restrictive, the scope of the invention being indicated by the appended claims, and not limited to the foregoing description. In the appended claims, the term "mop" will be understood generically to refer to any broom, mop, cloth, brush, duster or other article used for cleaning purposes, regardless of where or how they are used; and, the term "liquid" will be understood to refer to water as well as to any cleaning fluid or other liquid known to persons of ordinary skill in the cleaning arts as efficacious for the removal of particulate matter from a mop, cloth, brush, duster or other article used for cleaning purposes, provided that said liquid is capable of being spray misted onto particulate matter to form a combination 182 of particulate matter and liquid mist.

I claim:

1. An apparatus for cleaning a mop that contains particulate matter, comprising:

(a) a frame;

(b) a substantially closed chamber mounted to the frame, said chamber having an air stream inlet opening and an exit opening to permit air to return to the atmosphere;

(c) a drum shaft mounted to one or more bearings attached to the frame;

(d) a drum having a plurality of radially-outward directed, flexible, resilient fibers, said drum mounted to said drum shaft adjacent to said air stream inlet opening for rotation about the shaft;

(e) means attached to the frame for rotating the drum, said means including a drum shaft pulley rigidly attached to the drum shaft;

an electric motor mounted to the frame, said motor having a motor shaft equipped with a motor pulley; and a belt in driven engagement with the motor pulley and in driving engagement with the drum shaft pulley;

(f) means for creating a stream of air to draw atmospheric air under reduced pressure through the air inlet opening past the drum, into the chamber, and out the exit opening, whereby particulate matter loosened and separated from the mop by agitation caused by contacting the mop with the rotating fibers is carried along in the stream of air, said means including a drum housing that substantially surrounds the drum to confine the particulate matter to the interior of the apparatus, said drum housing having an access opening at the top thereof to permit a mop to contact the fibers as they rotate, and the bottom of the drum housing having a passageway to permit the air stream and particulate matter carried by the air stream away from the drum to exit the drum housing;

a fan shroud disposed below the drum housing and attached thereto, said shroud having an opening at the top thereof that communicates with the passageway of the drum housing in order to receive the stream of air from the drum housing, said shroud having an outlet opening directed toward the chamber for conducting the air stream into an inlet opening of the chamber, said shroud further having a bottom opening;

a fan compartment below the bottom opening of the shroud and in communication therewith; and an electric fan mounted within the fan compartment, said fan having an upstanding shaft to which fan blades are attached;

(g) a first solid air filter mounted adjacent to the exit outlet of the chamber;

(h) a second solid air filter mounted downstream from said first solid air filter.

(i) a tray removably mounted within the chamber intermediate said first and second solid air filters for collecting said loosened and separated particulate matter from said stream of air; and (j) means for spraying a liquid mist onto particulate matter within the chamber to create combinations of particulate matter and liquid mist, said combinations being generally heavier than the particulate matter prior to spraying the liquid mist thereon and thus inclined to drop out of the stream of air onto said tray, said means including a liquid reservoir tank mounted to the frame, which tank has a filling cap and a liquid outlet and, when the apparatus is operating, contains liquid;

an electric pump connected to the liquid outlet of the tank; and one or more spray nozzles connected to an outlet of the pump and directed transversely to the stream of air and toward said tray.

* * * * *